US006954191B1

(12) United States Patent
Hirano et al.

(10) Patent No.: US 6,954,191 B1
(45) Date of Patent: Oct. 11, 2005

(54) LIQUID CRYSTAL DISPLAY DEVICE

(75) Inventors: Satoshi Hirano, Tokyo (JP); Masaru Yasui, Kobe (JP); Takeo Kamiya, deceased, late of Kobe (JP); by Akihiko Miyazaki, legal representative, Kawasaki (JP); Shuji Hagino, Kobe (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 632 days.

(21) Appl. No.: 09/889,088

(22) PCT Filed: Nov. 10, 2000

(86) PCT No.: PCT/EP00/11288

§ 371 (c)(1),
(2), (4) Date: Jan. 17, 2002

(87) PCT Pub. No.: WO01/37251

PCT Pub. Date: May 25, 2001

(30) Foreign Application Priority Data

Nov. 12, 1999 (JP) ..... 11-321902
Oct. 3, 2000 (JP) ..... 2000-330859

(51) Int. Cl.[7] ..... G09G 3/36
(52) U.S. Cl. ..... 345/77; 345/87

(58) Field of Search ..... 345/77, 87–89, 345/48, 63, 32, 600; 348/229.1; 382/279

(56) References Cited

U.S. PATENT DOCUMENTS 6,577,291 B2 * 6/2003 Hill et al. ..... 345/89
6,608,942 B1 * 8/2003 Le ..... 382/279
6,657,607 B1 * 12/2003 Evanicky et al. ..... 345/88
6,667,765 B1 * 12/2003 Tanaka ..... 348/229.1
6,750,874 B1 * 6/2004 Kim ..... 345/600
6,771,233 B1 * 8/2004 Kim ..... 345/32

FOREIGN PATENT DOCUMENTS

JP 10-10998 1/1998

OTHER PUBLICATIONS

Japanese Patent Application Laid–Open No. 10998/1998.

* cited by examiner

*Primary Examiner*—Dennis-Doon Chow
*Assistant Examiner*—Srilakshmi K. Kumar

(57) ABSTRACT

This invention relates to an RGBW-typed LCD wherein a proper luminous image can be displayed according to a predetermined calculation with a decoder where some predetermined calculation formulas are embedded. Further, not only RGBW image display but also RGW image display can be used by a predetermined controlling signal.

18 Claims, 5 Drawing Sheets

LIQUID CRYSTAL DISPLAY DEVICE

This invention relates to a liquid crystal display apparatus capable of color displaying.

In recent years, a liquid crystal display apparatus capable of color displaying is widely used as a display apparatus, for example, for a personal computer, a video camera and a car navigation system.

A Liquid crystal display apparatus of RGBW type (hereinafter referred to as a RGBW type liquid crystal display apparatus) in which a transparent filter (W) is arranged in addition to a RGB filter of the conventional RGB type has been proposed in Japanese Patent Application Laid-open No.10998/1998, which relates to a method for improving luminance of a pixel of a liquid crystal panel of this liquid crystal display apparatus.

However, even though attempting improvement of luminance of the liquid crystal panel by merely adding the transparent filter, a white color is mixed in all display colors if luminance of a part of pixels of the transparent filter is not controlled in an independent manner appropriately, so that color purity (saturation) is degraded, and the image with a display color which is not intended, which is different from an original image is destined to be displayed.

Accordingly, the first object of the invention is to provide a RGBW type liquid crystal display apparatus capable of properly improving luminance of the image output from the liquid crystal panel by controlling luminance of the pixel of the transparent filter in an independent manner appropriately under a predetermined calculation when establishing luminance of the liquid crystal panel.

According to the liquid crystal display apparatus described in claim 1, said predetermined calculation processing by said data calculating means obtains said digital value for driving said luminance-intensifying subpixel by a function of W=f(Ymin, Ymax) in case where said digital value of said luminance-intensifying pixel is defined as W and Ymin and Ymax of said digital values of each of said red inputting subpixel, said green inputting subpixel and said blue inputting subpixel are respectively defined as a minimum value and a maximum value, whereby said first object can be achieved.

According to the liquid crystal display apparatus described in claim 2, said function of W=f(Ymin, Ymax) is directed to a function which is monotonously increased as said Ymin value or said Ymax value becomes larger, whereby said first object can be achieved.

According to the liquid crystal display apparatus described in claim 3, said function of W=f(Ymin, Ymax) is directed to a function where said Ymin is a variable value and said Ymax is a constant value and a function which is monotonously increased as said Ymin value becomes larger, whereby said first object can be achieved.

According to the liquid crystal display apparatus described in claim 4, in a case where $\alpha$, $\beta$ and n are predetermined real numbers and a maximum value which can be adopted regarding as said red inputting subpixel, said green inputting subpixel and said blue inputting subpixel, is defined as MAX, said function of w=f(Ymin, Ymax) being represented by a function of $W=Max*\{(Ymin+\alpha)+(MAX+\beta)\}^n$ by which a digital value for driving said luminance intensifying subpixel is obtained, whereby said first object can be achieved.

According to the liquid crystal display apparatus according to any of claims 1 and 4, in a case where a digital value of any of said red inputting subpixel, said green inputting subpixel and said blue inputting subpixel is directed to zero value, a value of said W is directed to zero value, whereby said first object can be achieved.

According to the liquid crystal display apparatus described in claim 6, said apparatus comprises:

storing means for storing a plurality of kinds of functions represented by said function of W=f(Ymin, Ymax); and selecting means for selecting any of said plurality of kinds of functions represented by said function of W=f (Ymin, Ymax) stored by said storing means, whereby said first object can be achieved.

According to the liquid crystal display apparatus described in claim 7, wherein said red outputting subpixel, said green outputting subpixel and said blue outputting subpixel are constituted as a main pixel unit without using said subpixel for luminance, thereby to be able to use as a liquid crystal display apparatus capable of color-displaying, whereby the second object can be achieved.

According to the liquid crystal display apparatus described in claim 8, wherein it is made possible to perform an image display which said red outputting subpixel, said green outputting subpixel and said blue outputting subpixel are constituted as a main pixel unit without using said subpixel for luminance, and an image display which said red outputting subpixel, said green outputting subpixel and said blue outputting subpixel are constituted as a main pixel unit using said subpixel for luminance at same time, whereby the second object can be achieved.

These and other aspects of the invention are apparent from and will be elucidated with reference to the embodiments described hereinafter.

Figure 1:
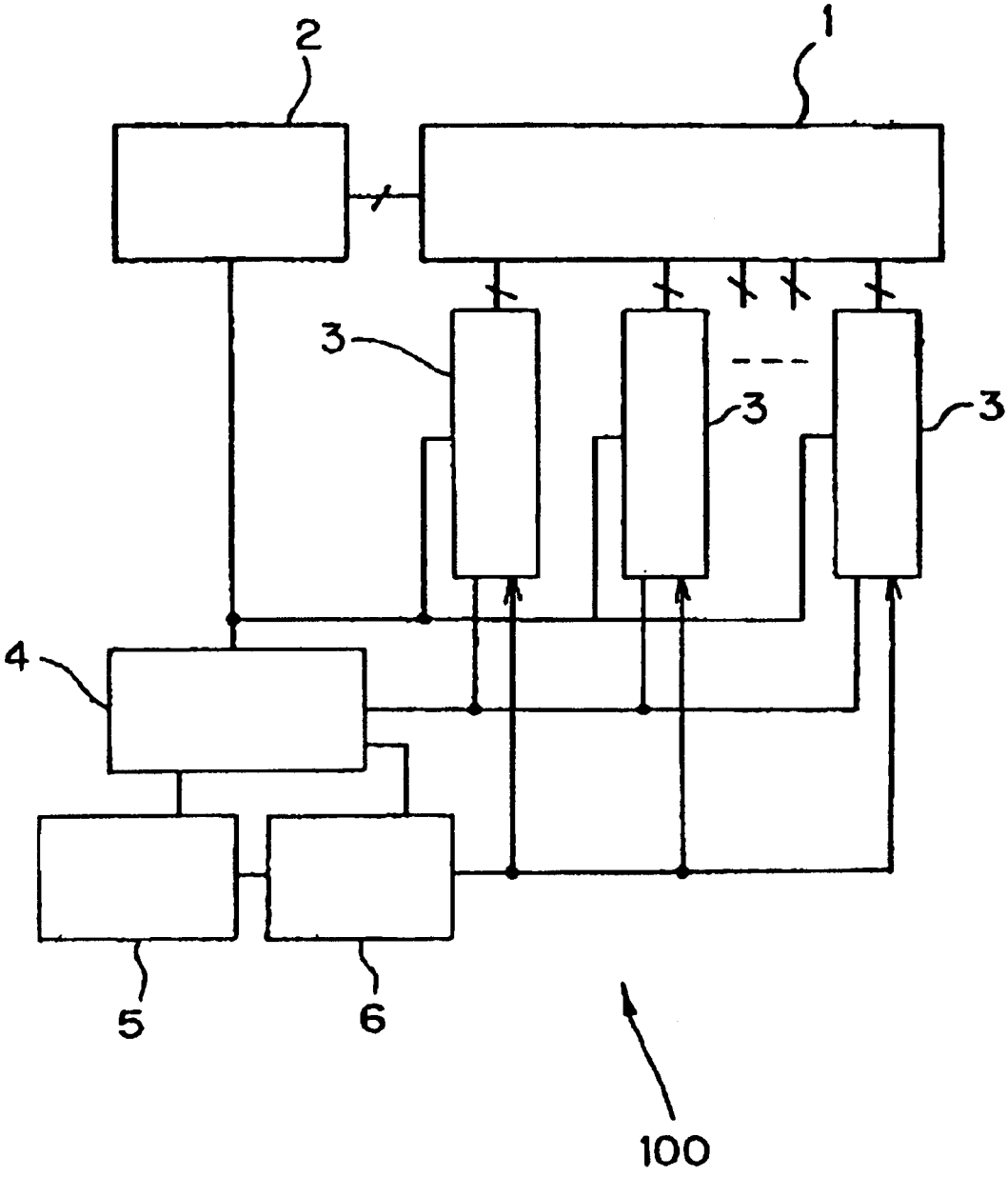
FIG. 1 is a block diagram showing a constitution of a liquid crystal display apparatus 100 of a preferred embodiment according to the invention.
Figure 2:
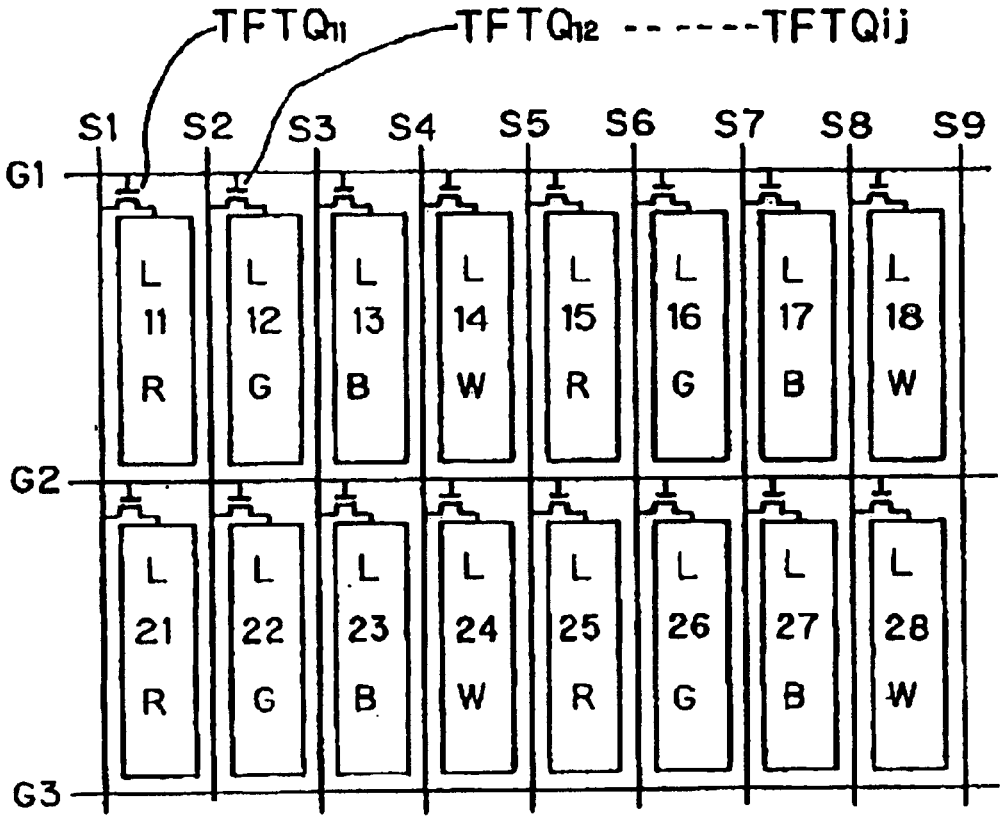
FIG. 2 is a top plane view for illustrating an arrangement of a subpixel, a gate bus, and a source bus of a liquid crystal panel 1 shown in FIG. 1.

FIG. 1 is a block diagram showing a constitution of a liquid crystal display apparatus 100 of one first embodiment according to this invention. This liquid crystal display apparatus 100 is provided with a liquid crystal panel 1. FIG. 2 is a top plane view schematically showing a horizontal portion of this liquid crystal panel 1. This liquid crystal panel 1 is provided with row-like gate buses G1 to Gm (m: a natural number) and column-like like source buses S1 to Sn (n: a natural number) as shown in FIG. 2. Moreover, the gate buses G1 to Gm are connected with the gate driver 2, and the source buses S1 to Sm are connected with the source driver 3.

Moreover, subpixels Lij of R (red), G (green), B (blue) or W (white (for reinforcement of luminance)) are arranged in meshes which the gate bus Gi and G1+1 (i=1 to m) and the source bus Sj and Sj+1 (j=1 to m) form.

Moreover, TFTs (thin film transistors) Qij are arranged in the vicinity of the intersections of the gate buses Gi and the source buses Sj. Furthermore, the gate bus Gi is connected with the gate of the TFT Qij, the source bus Sj with the source of TFTQij, and the display electrode of each subpixel Lij with the drain of the TFT Qij. Moreover, the electrode opposed to the display electrode of each subpixel Lij is a common electrode 12, and this common electrode 12 is connected with a voltage supply circuit (not shown).

Moreover, the color filter for the RGBW is arranged for each the subpixel Lij as follows, when the subpixels are arranged in a longitudinal stripe form as shown in FIG. 2 and one pixel is constituted from four subpixels of the RGBW.

R:Lij (i=1, 2, 3, . . . , m−1, j=1, 5, 9, . . . , n−3)

G:Lij (i=1, 2, 3, . . . , m, j=2, 6, 10, . . . , n−2)

B:Lij (i=1, 2, 3, . . . , m, j=3, 7, 1, . . . , n−1)

W:Lij(I32 1, 2, 3, . . . , m—1, j=4, 8, 12, . . . , n)

In this liquid crystal panel 1, these subpixels form a longitudinal stripe arrangement.

Moreover, a TFT substrate on which the subpixel electrode is formed, a color filter substrate on which the common electrode is formed and a glass substrate or the like, which are not shown, are arranged in a direction perpendicular to a panel surface of the liquid crystal panel 1, and a liquid crystal is filled in such a manner as to be sandwiched between these substrates. In the color filter substrate, although the red, green and blue semitransparent color filters are arranged respectively at a part corresponding to the above-described subpixel RGB, the color filter is not arranged at a part corresponding to the subpixel W, or the transparent filter is arranged.

Returning to FIG. 1, the description of the liquid crystal display apparatus 100 will be continued. The Gate driver 2 and eight source drivers 3 are arranged around the liquid crystal panel 1. An amplifier, a DAC (a DA converter) and a latch, which are not shown, are arranged in each source driver 3. Moreover, this liquid crystal display apparatus 100 has a signal control section 4. This signal control section 4 supplies a power supply voltage, as well as supplies control signals to the gate driver 2, the source driver 3, an image data holding section 5, and a decoder 6. The decoder 6 is connected with each source driver 3. Moreover, the image data holding section 5 in which each subpixel input data Ri, Gi, and Bi with eight bits of the red, green and blue colors of the image acquired in digitalized form are held is connected with this decoder 6.

Moreover, the liquid crystal display apparatus 100 comprises a reference potential generating circuit applying reference potential on the basis of a predetermined clock frequency to each source driver 3 (not shown).

The operation of the liquid crystal display apparatus 100 shown in FIG. 1 will be described below.

The control signal is supplied from the signal control section 4 to the gate driver 2 and each source driver 3. The gate driver 2 transmits a signal for turning TFTQij into the on condition to each of gate buses (refer to FIG. 2) based on the control signal.

Moreover, subpixel outputting luminance data Ro, Go, Bo and Wo of eight bits are latched in the latch portion (not shown) of each source driver 3 based on the control signal, when the control signal is supplied to each source driver 3.

Moreover, these subpixel outputting luminance data Ro, Go, Bo and Wo of eight bits can be obtained as a result of performing the predetermined calculation (will be described later) by the decoder 6 for subpixel inputting data Ri, Gi, and Bi constituting the digital image which is held on the image data holding section 5.

Subpixel outputting luminance data Ro, Go, Bo and Wo latched in the above-description latch portion are output in order and are input to the DAC portion (not shown). Moreover, the control power supply 4 outputs a polarity control signal for controlling whether the DAC portion selects potential from positive polarity reference potential generated from the reference potential generating circuit or selects potential from negative polarity reference potential, and this polarity control signal is input to the DAC portion. The DAC portion selects potential corresponding to these W subpixels outputting luminance data Ro, Go, Bo and Wo from potential which is generated by the reference potential generating circuit based on the input polarity control signal and subpixel outputting luminance data Ro, Go, Bo and Wo.

When potential is selected by the DAC portion, the DAC portion divides a voltage of the selected potential by resistance division into several steps appropriately so as to obtain a desired gradation. The divided voltage is current-amplified by an amplifier and transmitted to a corresponding one of the source buses S1 to Sn (refer to FIG. 2). When the TFT becomes on by the signal transmitted to one of the gate buses G1 to Gm, this signal of the potential transmitted to this source bus is transmitted to each subpixel electrode by way of this TFT.

According to this operation, potential corresponding to subpixel outputting luminance data is added to each subpixel electrode. Therefore, a voltage is supplied to the liquid crystal layer which is sandwiched between a common electrode and each subpixel electrode, and the liquid crystal layer is driven in response to potential added to each subpixel electrode, so that the image is displayed on the liquid crystal panel 1 by principle of additive color mixing.

Figure 3:
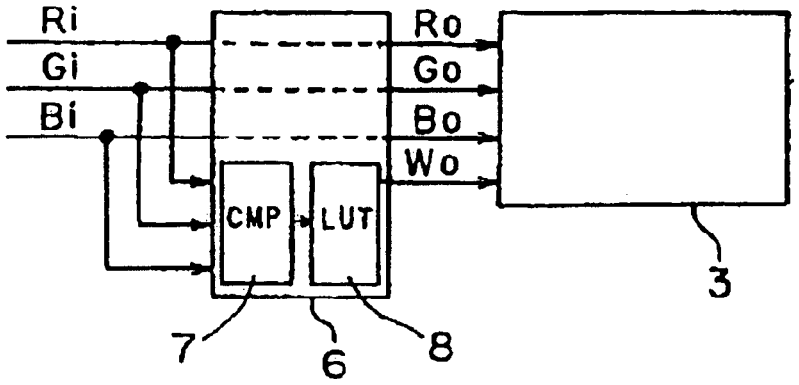
FIG. 3 is a block diagram schematically representing a source driver 3 and a decoder 6 shown in FIG. 1.

The preferred embodiment in relation to calculation processing of the decoder 6 mentioned above will be described with reference to FIG. 3 in further detail below. The decoder 6 acquires each input subpixel digital data Ri, Gi, and Bi of the red, green and blue colors of eight bits from the image data holding section 5 to output RGBW subpixel outputting luminance data Ro, Go, Bo and Wo from these Ri, Gi, and Bi to the source driver 3 as shown in FIG. 3.

On the other hand, the following processing is required in order to obtain W subpixel outputting luminance data Wo.

The decoder 6 is provided with a comparator 7 and a look-up table 8. The comparator 7 converts this value into dimensions of luminance data after comparing values of input subpixel digital data Ri, Gi, and Bi acquired as described above to select a minimum value Ymin of the values of these Ri, Gi, and Bi.

Next, the look-up table 8 converts the Ymin value thus selected and converted it into W subpixel outputting luminance data Wo by this comparator 7.

The conversion to W subpixel outputting luminance date Wo of the Ymin value described above can be realized easily by using PROM in which the calculated result of a mathematical formula 1 which is mentioned later, for each value of Ymin which changes from zero to 255 (in the case of 256-step gradation) is stored in a Ymin address. Furthermore, the control signal from the signal control section 4 to decoder 6 and memory or the like in which data is stored are not required if being a circuit constitution for only this object.

However, since a delay by some number of clocks is caused while the comparator and the look-up table outputs W subpixel outputting luminance data Wo after input subpixel data Ri, Gi, and Bi are input in the decoder 6, the long time can be required. At that time, output of RGB subpixel outputting luminance data Ro, Go and Bo is required to be delayed within decoder 6 in synchronization with outputting of W subpixel outputting luminance data Wo.

As described above, the decoder 6 determines W subpixel outputting luminance data Wo from input subpixel data Ri, Gi, and Bi obtained from an input original image.

Furthermore, the above-mentioned mathematical formula 1 will be described. The mathematical formula 1 is an optional function which is are represented by Wo=f (Ymin, Ymax), when W subpixel outputting luminance data is taken as Wo, and a minimum value is taken as Ymin, a maximum value is taken as Ymax of the digital values respectively for each of a red inputting pixel, a green inputting pixel, and a blue inputting pixel.

A function which is monotonously increased as said Ymin value or said Ymax value becomes larger can be adopted as the function which is represented by this mathematical formula 1. For example, it is the function of $Wo=(Ymax*Ymin)/MAX^2$. Here, MAX is the largest value which can be taken, of the values of input luminance data of Ri, Gi and Bi.

Furthermore, $WO=MAX*\{(MINRGB+\alpha)/(MAX+\beta)\}^n$ (hereinafter referred to this mathematical formula simply as a mathematical formula 2) is given as the other preferred examples of the mathematical formula 1. This mathematical formula 2 will be described in detail below. This mathematical formula 2 is the function in which a minimum value of RGB subpixel inputting luminance data which is output in the decoder 6 is defined as a variable, thereby to determine W subpixel outputting luminance data Wo.

In this mathematical formula 2, Wo is output luminance data for W subpixel, MAX is the largest value which can be taken, of the input luminance data value of Ri, Gi and Bi as is described above, and MINRGB is the minimum value which can be taken, of the input luminance data value of Ri, Gi and Bi. Moreover, $\alpha$, $\beta$ and n are optional real numbers.

The values of $\alpha$, $\beta$ and n are determined by optical characteristics such as luminance which is set as the target of the liquid crystal display apparatus 100. For example, the condition in which $\beta=0$ is obtained can be introduced from the condition in which Wo is made into MAX, that is, the condition that gives the largest luminance to the liquid crystal panel 1 of the liquid crystal display 100, when the minimum value MINRGB (Ymin) of input luminance data of Ri, Gi and Bi is MAX.

Moreover, the condition in which $\alpha=0$ and $\beta=0$ is obtained can be introduced from the condition that the contrast can not be degraded, which is concomitant with the liquid crystal display 100 inherently, since the condition in which Wo is made zero when the minimum value MINRGB (Ymin) of input luminance data of Ri, Gi and Bi is zero, and the condition in which Wo=MAX is obtained when the minimum value MINRGB (Ymin) of input luminance data of Ri, Gi and Bi is MAX, under this condition.

Optionally, when the color to be displayed for the liquid crystal display apparatus 100 is 256 step gradation, MAX value is MAX=255.

The calculation by the mathematical formula 2 also can be realized using the look-up table (LUT) which the decoder 6 comprises as described above. Such look-up table can be built-in ASIC of the decoder 6 easily, and can be realized easily with PROM and EEPROM which have a storage capacity of 256 byte when each input of RGBW and luminance date are of eight bits, such a look-up table. The values of $\alpha$ and $\beta$ described above are set in the look-up table in advance in accordance with the optical characteristics (luminance) which are desired in the liquid crystal display apparatus.

Here, the theory which is founded at determining the mathematical formula 2 will be described with reference to a chromaticity diaphragm in FIG. 4 complementarily below.

Figure 4:
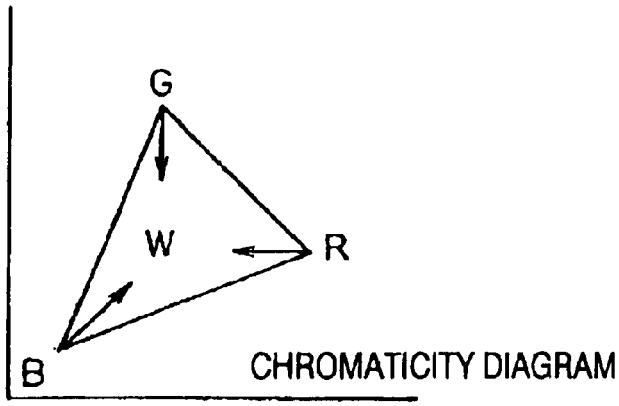
FIG. 4 is a chromaticity diaphragm using to illustrate a mathematical formula 2.

Now, when Ri, Gi, and Bi and each point in R, G, B and W on the chromaticity diaphragm in FIG. 4 are in the following relationship, that is, the relationship that it corresponds to the point R when being Ri=MAX and G=B=0, the point G when being G=MAX and R=B=0, the point B when being B=MAX and R=G=0, and furthermore, the point W when being Ri=MAX and R=G=B are satisfied, the following conclusion can be obtained. "When either of value of R, G and B is larger than zero, the chromaticity is inside the triangle RGB in FIG. 4." "Namely, the color is provided with a white (gray)-colored component, approaching the point W."

Furthermore, the following conclusion can be obtained with regard to W from the conclusion described above.

(1) "In the case of R=G=B, only luminance can be increased without change in chromaticity even though adding W thereto."

(2) "Since the triangle RGW represents the range of the color which the liquid crystal display apparatus can be expressed, W=0 is set, when at least any one of R, G and B is zero in order not to make this range narrow."

(3) "The chromaticity where either of R, G and B is larger approaches the point W as the minimum value of R, G and B becomes larger." "That is to say, the minimum value of R, G and B represents how the color is white." "Therefore, if W is given as the function of the minimum value of R, G and B, luminance can be increased without excessively large changing the chromaticity where one pixel is constituted by three pieces of subpixel of R, G and B."

Accordingly, the mathematical formula 2 which can give W as the function of the minimum value (MINRGB) of R, G and B could be derived in view of the conclusions of items (1), (2) and (3) described above.

Next, some embodiments (example 1 to 3) that the decoder 6 determines Wo using this mathematical formula 2 will be described with reference to a graph of the mathematical formula 2 in FIG. 5 below.

Figure 5:
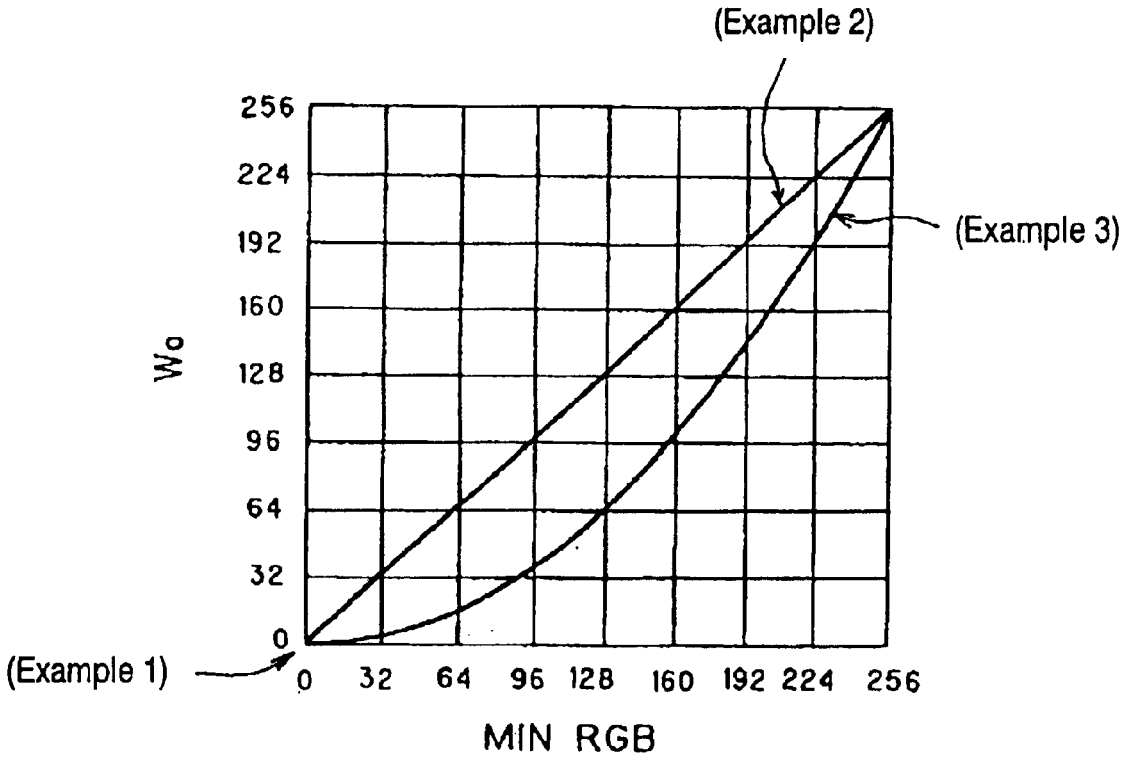
FIG. 5 is a graph of a calculated result obtained by using a mathematical formula 3.

FIG. 5 is a graph of the mathematical formula 2 in the case where the above-mentioned MINRGB value determined by the decoder 6 is taken as a variable of X axis, and Wo value being determine by substituting the MINRGB value into the mathematical formula 2 is taken as a variable of Y axis, when the number of maximum gradation of each pixel of the display image is 256-step gradation.

As example 1, the case where any one of the values of luminance data of Ri, Gi and Bi is zero will be described. In this case, since MINRGB=O, Wo=0 is obtained from calculation of the mathematical formula 2 (on X axis of the graph in FIG. 5). Namely, Wo=0 can be designed to realize, whereby color purity (saturation) can not be reduced in this case.

As example 2, the case which $\alpha=\beta=0$ and n=1 are set in the mathematical formula 2 will be described. In this case, since the mathematical formula 2 is transformed into Wo=MINRGB, the result which is represented by the straight line in FIG. 5 (example 2) can be obtained. Therefore, gamma($\gamma$) characteristic of the original image before being input in the image data holding portion 5 can be held in this case. Moreover, the constitution of a circuit to be added is simple, and the scale of the constitution constituting the circuit also is needed in a small size.

As example 3, the case which "n" value is set larger than numerical value "1" in the mathematical formula 2 will be described. In this example 3, n=2 and $\alpha=\beta=0$ are set. Moreover, MAX=255 is set. From this setting, the mathematical formula 2 is represented with $Wo=255*(MINRGB/255)^n$ (hereinafter referred to this mathematical formula as "a mathematical formula 3"), and this mathematical formula 3 is represented with the graph of FIG. 5 (example 3).

As understood from the graph of this (example 3), the Wo value becomes larger suddenly as the MINRGB value is larger. That is to say, according to the calculation processing by this mathematical formula 2, a white display of approximately 100% to other display color can be realized in a glaring manner, since luminance (Wo) for W subpixel becomes high suddenly, as MINRGB value approaches the maximum step number of gradation. As a result, radiance of a white cloud irradiated with the solar light which heretofore, has been realized by only CRT and, a display of a glittering luster of a metallic surface has come to be able to display.

Moreover, as understood from the graph of this (example 3), the graph of Wo is noticeable in the curved shape protruded downwardly (monotonously increased) in a variable region of the middle value which MINRGB value can take. As a result, luminance (Wo) for W subpixel can be suppressed in a halftone such as MINRGB=64 to 192, for example, and the original chromaticity (saturation) in the halftone can be held in the display image.

As described above, various images becomes possible by defining a constant of the mathematical formula 2 as required according to said embodiments. It may be designed to select such that the image which an user desires can be obtained from the exterior by storing the functions such as examples 1 to 3 described above for determining Wo in a plurality of pieces in the look-up table provided on the decoder 6 in advance.

As described above, according to said embodiments, appropriate W subpixel outputting luminance data can be determined in response to the image to be displayed by performing the calculation processing based on the mathematical formula 1 by the decoder 6. Moreover, the optical characteristics with various luminance desired in the liquid crystal display apparatus 100 can be provided by setting various functions in the look-up table provided on the decoder 6 in advance.

Next, as mentioned above, the constitution that the liquid crystal panel 100 can be used also as the RGBW type liquid crystal display and also as the RGB type liquid crystal display will be described with reference to a block diagram in FIG. 6 in which the constitution according to a block diagram in FIG. 3 is noted as a main part as a further embodiment.

Figure 6:
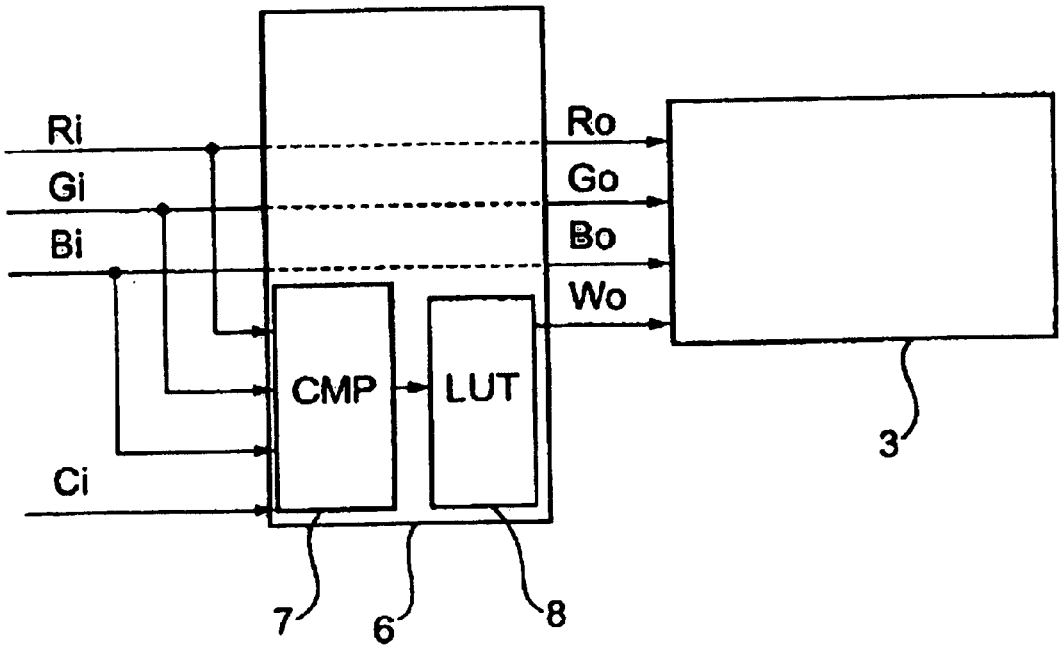
FIG. 6 is a top plane view showing a modification of an embodiment shown in FIG. 2.

A control signal Ci functioning as further one bit of switching control signal is added in addition to input signals Ri, Gi, and Bi in order to achieve this further embodiment, as shown in FIG. 6. This Ci signal is synchronized with clock frequency of the described-above input signals Ri, Gi, and Bi, and all the circuit in FIG. 6 performing a function for displaying RGBW is enabled, when this Ci signal is HIGH. On the other hand, CMP7 and LUT6 are skipped, Wo=0 is set, and the input signals Ri, Gi, and Bi are output as output signals Ro, Go, and Bo as it is, when this Ci signal is LOW.

According to this operation, displaying of either of RGB display or RGBW display becomes possible by switching HIGH and LOW of the Ci signal. Moreover, it may be designed to set such that Wo=0 is set merely in LUT8, when RGB display is desired.

Switching of the Ci signal may be performed through software by the PC which the liquid crystal display apparatus 100 is provided, or the switching may be designed to perform when pushing a short-cut-key or the like in a key board of the PC.

According to this operation, it can be used as the RGB type liquid crystal display apparatus since there is no necessity to brighten a white color in particular when preparing a text in an office work, on the other hand, it can be used as the RGBW type liquid crystal display apparatus, when it is desired to highlight a snow scene, brightness of a car polished with a wax sufficiently, and a cloud, or a white-colored text such a telop for an advertisement.

A part thereof can display the screen for RGBW, and another part can display the screen for RGB by using a window of the screen of the PC. In this case, it is constituted such that a pixel according to the Ci signal gives characterization on a pixel according to the input signals Ri, Gi, and Bi by each pixel unit, that is, the Ci signal can display the RGBW display at the pixel in the window screen of High and the Ci signal can display the RGB display at the pixel in the window screen of Low, for example. According to this constitution, for example, the screen which a luster obtained from a metallic surface of the car is highlighted can be displayed at the window screen of the half of the right side and a text document which a profile or the like of the car is written can be displayed at the window screen of the half of the left side by providing the liquid crystal display apparatus according to the invention on the PC at a sales office and an exhibition of the car for the advertisement. The text document can be displayed on the other side by weakening the white color and to make easy to read for observers rather than without highlighting a white color (luminance) so much, while taking advantage of a merit comprised in the RGBW screen.

Moreover, in the RGBW type liquid crystal display, an apparent difference in luminance of the white color where comparing with the RGB type liquid crystal display is recognized when observing the screen from a slightly distant position, whereby the RGBW type liquid crystal display apparatus according to the invention can show noticeable effects in the case that the observer observes a white-colored character such as a telop with the RGBW type liquid crystal display apparatus from a distant position, at the crowded exhibition, and the case or the like that the observer should observe the RGBW type liquid crystal display from a distant position inevitably, which is provided on a wall surface or the like of a building.

Moreover, the inventions described in each claim should not be limited to each embodiment mentioned above, and various modifications can be adopted within the scope described in each claim as described below.

Some modifications will be described below.

(1) Modification 1: although in a preferred embodiment, subpixel RGBW has been aligned in the form of longitudinal stripe arrangement as shown in FIG. 2, it may be aligned in a form of a mosaic-shape as shown in FIG. 6. In this case, an individual form of the subpixel is approximately square.

Figure 7:
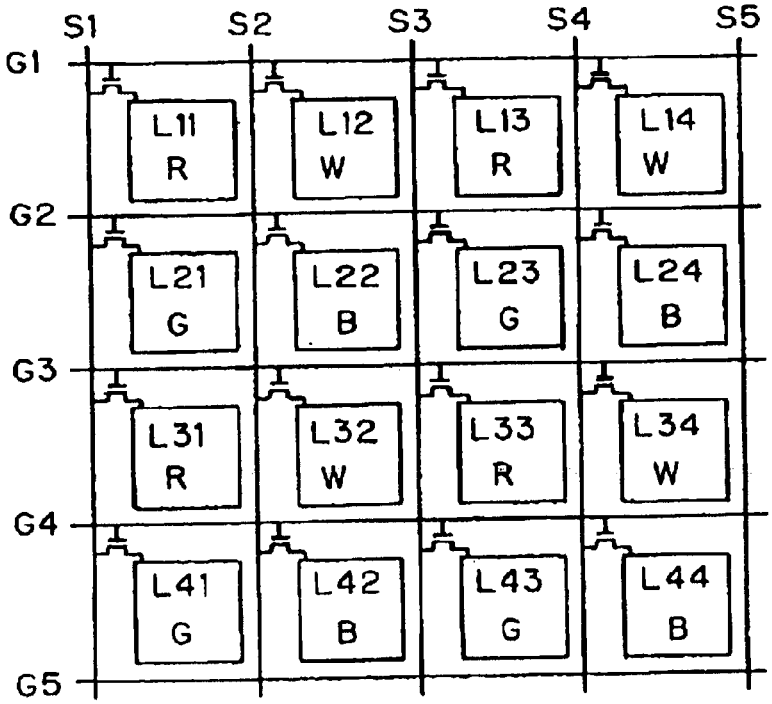
FIG. 7 is a top plane view showing a modification of an embodiment shown in FIG. 2
Figure 8:
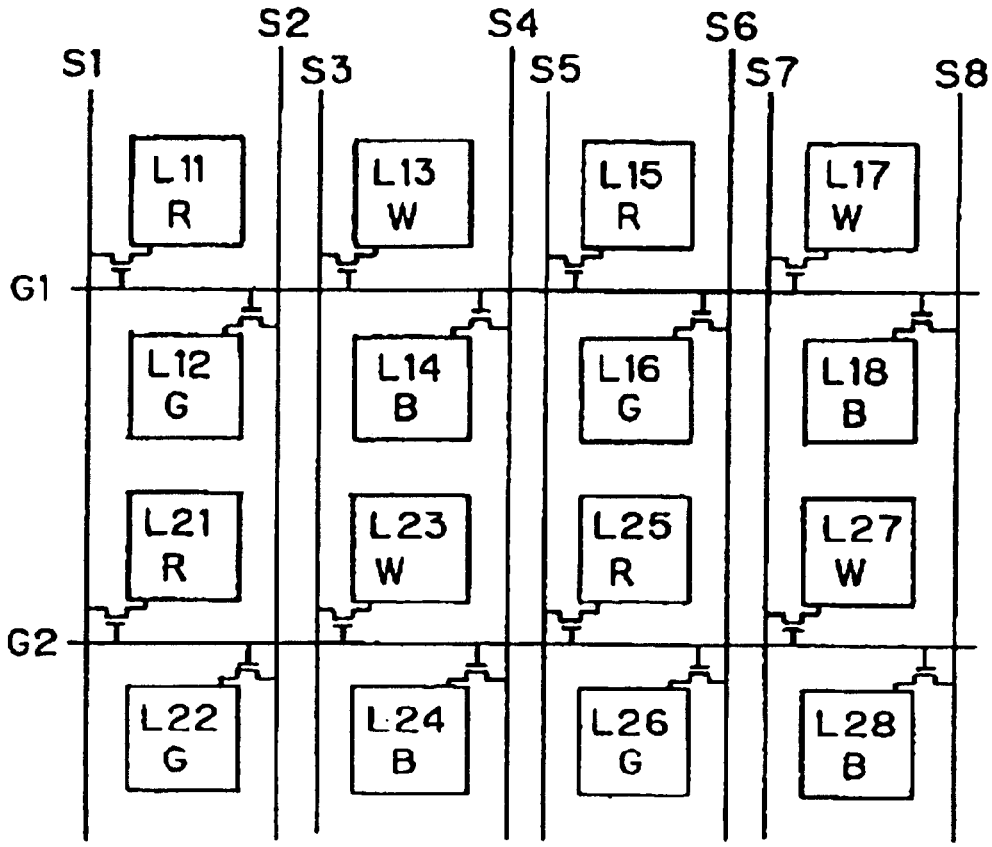
FIG. 8 is a block diagram representing a modification of an embodiment shown in FIG. 3.

(2) Modification 2: although in the described-above modifications 1, meshes of a net are formed by the source buses and the gate buses and, the individual subpixel is made to arrange in the meshes of the net one by one as shown in FIG. 7, the gate bus may be wired by one piece every two steps of the subpixel, the source bus may be wired by two pieces between one step of subpixel as shown in FIG. 7. According to such constitution, the number of the gate bus is the same as the prior RGB type, and a writing characteristic of the TFT would remain as it is the prior art. Moreover, according to the constitution, it has become unnecessary to sort a source signal every one row in the source driver 3, since a color of the subpixel which is connected with a piece of source bus becomes one kind.

Figure 9:
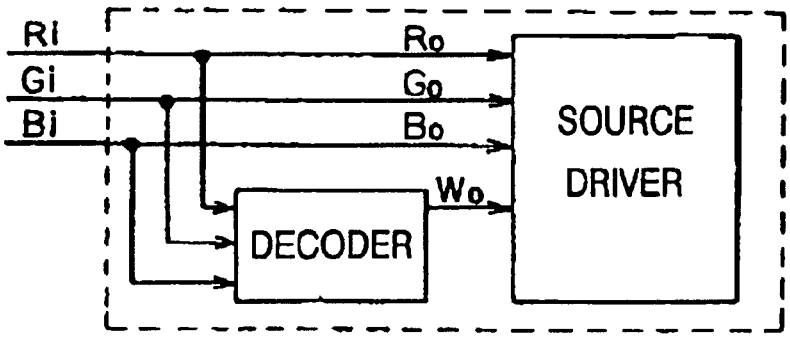
FIG. 9 is a block diagram schematically representing a possible modified arrangement for the source driver 3 and decoder 6.

(3) Modification 3: although the decoder 6 and the source driver 3 are formed as separated bodies as shown in FIG. 3 in the described-above preferred embodiment, these may be arranged as an integrated structure of the decoder and the source driver by arranging the decoder in an entrance portion of the inside of the source driver, as shown in FIG. 9. According to such constitution, an increase by the amount corresponding to luminance date for W subpixel in the number of data wiring in the printed circuit board can be avoided.

As described above, according to the liquid crystal display apparatus of this invention, luminance of the image displayed with the liquid crystal panel can be improved appropriately.

What is claimed is:

1. A liquid crystal display apparatus capable of color-displaying comprising:

a crystal panel having, in each main pixel unit, a red outputting subpixel, a green outputting subpixel, a blue outputting subpixel, and a luminance-intensifying subpixel, and a decoder that is configured to provide a digital value for driving the luminance-intensifying subpixel by carrying out a predetermined calculation processing using digital values respectively for a red inputting pixel, a green inputting pixel, and a blue inputting pixel which are obtained from an input image, wherein:

the liquid crystal displaying apparatus driving the luminance-intensifying subpixel, the red outputting subpixel, the green outputting subpixel and the blue outputting subpixel by using the digital value for driving the luminance-intensifying subpixel obtained by the decoder and the digital values of the red, green and blue inputting subpixels, and the predetermined calculation processing obtains the digital value for driving the luminance-intensifying subpixel by a function of W=f(Ymin, Ymax) where the digital value of the luminance-intensifying pixel is defined as W, and a minimum value and a maximum value of the digital values of the red inputting subpixel, the green inputting subpixel and the blue inputting subpixel are respectively defined as Ymin and Ymax, and the function f(Ymin, Ymax) provides an output value that is dependent upon both Ymin and Ymax.

2. A liquid crystal display apparatus according to claim 1, wherein the function of W=f(Ymin, Ymax) is directed to a function that monotonically increases as Ymin or Ymax increases.

3. A liquid crystal display apparatus according to claim 1, further including:

a memory that is configured to store a plurality of kinds of functions each represented by the function of W=f (Ymin, Ymax); and a selector that is configured to select from among the plurality of kinds of functions represented by the function of W=f(Ymin, Ymax) stored by the memory.

4. A liquid crystal display apparatus according to claim 1, wherein the red outputting subpixel, the green outputting subpixel and the blue outputting subpixel are arranged to form a main pixel unit without using the luminance-intensifying subpixel in accordance with a predetermined control signal.

5. A liquid crystal display apparatus according to claim 1, wherein the function W=f(Ymin, Ymax) is given as a function $W=(Ymax*Ymin)/MAX^2$, where MAX is a maximum value which digital values of the red inputting subpixel, the green inputting subpixel and the blue inputting subpixel can take.

6. A liquid crystal display apparatus according to claim 5, further including a memory that is configured to store at least one other function for determining W, and a selector that is configured to select among the functions for determining W stored by the memory.

7. A liquid crystal display apparatus according to claim 6, wherein the at least one other function includes $W=Max*\{(Ymin+\alpha)/(MAX+\beta)\}^n$, where MAX is a maximum value which digital values of the red inputting subpixel, the green inputting subpixel and the blue inputting subpixel can take.

8. A liquid crystal display apparatus according to claim 6, wherein the decoder is further configured to:

receive a control signal, and selectively provide the digital value for driving the luminance-intensifying subpixel based on the control signal.

9. A liquid crystal display apparatus according to claim 5, wherein the decoder is further configured to:

receive a control signal, and selectively provide the digital value for driving the luminance-intensifying subpixel based on the control signal.

10. A liquid crystal display apparatus according to claim 1, wherein the decoder is further configured to:

receive a control signal, and selectively provide the digital value for driving the luminance-intensifying subpixel based on the control signal.

11. A liquid crystal display apparatus capable of color-displaying comprising:

a crystal panel having, in each main pixel unit, a red outputting subpixel, a green outputting subpixel, a blue outputting subpixel, and a luminance-intensifying subpixel, and a decoder that is configured to obtain a digital value for driving the luminance-intensifying subpixel by carrying out a predetermined calculation processing using digital values respectively for a red inputting pixel, a green inputting pixel, and a blue inputting pixel which are obtained from an input image, wherein:

the liquid crystal displaying apparatus driving the luminance-intensifying subpixel, the red outputting subpixel, the green outputting subpixel and the blue outputting subpixel by using the digital value for driving the luminance-intensifying subpixel obtained by the decoder and the digital values of the red, green and blue inputting subpixels, and the predetermined calculation processing by decoder provides the digital value for driving the luminance-intensifying subpixel by a function of W=f(Ymin, $\alpha$, $\beta$, n) where the digital value of the luminance-intensifying pixel is defined as W, and a minimum value of the digital values of the red inputting subpixel, the green inputting subpixel and the blue inputting subpixel is defined as Ymin, and $\alpha$, $\beta$, and n are predetermined real numbers, at least one of $\alpha$ and $\beta$ being non-zero, and a maximum value which digital values of the inputting subpixel, the green inputting subpixel and the blue inputting subpixel can take is defined as MAX, and the function of $W=f(Ymin, \alpha, \beta, n)$ is represented by a function of $W=MaX*\{(Ymin+\alpha)/(MAX+\beta)\}^n$.

12. A liquid crystal display apparatus according to claim 1, further including a memory that is configured to store at least one other function for determining W, and a selector that is configured to select among the functions for determining W stored by the memory.

13. A liquid crystal display apparatus according to claim 12, wherein the at least one other function includes $W=Max*\{(Ymin+\alpha)/(MAX+\beta)\}^n$, where MAX is a maximum value which digital values of the red inputting subpixel, the green inputting subpixel and the blue inputting subpixel can take.

14. A liquid crystal display apparatus according to claim 11, further including a memory that is configured to store at least one other function for determining W, and a selector that is configured to select among the functions for determining W stored by the memory.

15. A liquid crystal display apparatus according to claim 14, wherein the at least one other function includes $W=(Ymax*Ymin)/MAX^2$.

16. A liquid crystal display apparatus according to claim 15, wherein the decoder is further configured to:

receive a control signal, and selectively provide the digital value for driving the luminance-intensifying subpixel based on the control signal.

17. A liquid crystal display apparatus according to claim 14, wherein the decoder is further configured to:

receive a control signal, and selectively provide the digital value for driving the luminance-intensifying subpixel based on the control signal.

18. A liquid crystal display apparatus according to claim 11, wherein the decoder is further configured to:

receive a control signal, and selectively provide the digital value for driving the luminance-intensifying subpixel based on the control signal.

* * * * *